US005187693A

United States Patent [19]

Besson

[11] Patent Number: 5,187,693

[45] Date of Patent: Feb. 16, 1993

[54] DEVICE FOR CONTROLLING AND CORRECTING THE DISPLAY OF THE DAY AND DATE FOR A WATCH, AND A WRIST WATCH FITTED WITH SUCH A DEVICE

[75] Inventor: René Besson, Geneva, Switzerland

[73] Assignee: Montres Rolex S.A., Switzerland

[21] Appl. No.: 679,303

[22] Filed: Apr. 2, 1991

[30] Foreign Application Priority Data

Apr. 4, 1990 [CH] Switzerland ..... 01139/90

[51] Int. Cl.[5] ..... G04B 19/24; G04B 27/00

[52] U.S. Cl. ..... 368/35; 368/28

[58] Field of Search ..... 368/28, 37, 38, 34, 368/35

[56] References Cited

U.S. PATENT DOCUMENTS 3,664,120 5/1972 Golay et al. ..... 368/35
3,696,606 10/1972 Scholz ..... 368/35
4,060,976 12/1977 Jakob ..... 368/35
4,837,755 6/1989 Besson ..... 368/35

*Primary Examiner*—Bernard Roskoski
*Attorney, Agent, or Firm*—Davis, Bujold & Streck

[57] ABSTRACT

This device is specified for a wrist watch, comprising at least one bi-directional electric motor, at least one mechanism coupled to this motor to drive a day disk (12) and a date disk (10), and at least one electronic circuit designed to transmit control impulses to this motor. This mechanism comprises a drive wheel (11) coupled to the motor and two date fingers (14, 15) pivoting respectively on two axes (16, 17) borne by said drive wheel (11) to increment, and decrement respectively, the date disk (10). The drive wheel (11) also bears a control wheel (22) for a day star (13) designed to increment, or respectively decrement, the day disk (12) by means of said day star (13). The control wheel (22) for the day star is concentric with the drive wheel (11) and integral with the latter when it rotates in one direction or the other.

7 Claims, 7 Drawing Sheets

DEVICE FOR CONTROLLING AND CORRECTING THE DISPLAY OF THE DAY AND DATE FOR A WATCH, AND A WRIST WATCH FITTED WITH SUCH A DEVICE

The present invention relates to a device for controlling and/or correcting the display of the day and date for a watch, especially a wrist watch, comprising at least one bi-directional electric motor, at least one mechanism coupled to this motor to drive a day disk and a date disk, and at least one electronic circuit designed to transmit impulses to control this motor, in which the mechanism comprises a drive wheel coupled to the motor and two date fingers pivoting respectively on two axes supported by said drive wheel to increment, or decrement respectively, the date disk.

It also relates to a wrist watch fitted with such a device.

A device of this type is known from Swiss Patent no. 669 082 describing a device for controlling the display of the day or date, which allows, by means of a bi-directional electric motor, a correction or an effective and fast display of the day or date to be performed and any steps missed by the electric drive motor to be corrected.

The object of the present invention is to go beyond the objectives achieved by the device of the prior art by performing the display and correction of the day and the date simultaneously by means of a single bi-directional stepping motor and of an extremely reliable mechanism. As for the device of the prior art, the device of the present invention ensures the correction of any steps missed by the drive motor and permanently ensures the correct centring of the display mechanisms.

This object is achieved by the device according to the invention characterised in that the drive wheel also bears a control wheel for a day star, designed to increment, or decrement respectively, the day disk by means of said day star.

This device comprises a mechanism having one part which is intended to correct the date display and having another part which is intended to correct the day display. Although the construction of the part of the mechanism intended to correct the date display is slightly different from that described in the Swiss Patent mentioned above, the operating principle of the two systems is the same in the two cases.

According to a preferred embodiment, the control wheel of the day star is concentric with the drive wheel and integral with the latter during its rotational movements in one direction or the other.

According to an advantageous embodiment, the angular displacement of the control wheel of the day star is restricted to the angular displacement of the drive wheel.

The control wheel of the day star preferably comprises two tips symmetrical with respect to a median plane and designed to rest on a point of the day star and to make said day star move forwards, or move backwards respectively, by a step corresponding to one increment of the day disk.

The control disk of the day star may comprise a boss located between the tips, the radius of which is such that it ensures a locking of the day star when the control wheel is in its position of rest.

The device advantageously comprises a return spring mounted on a pin and which is in contact with an extremity of the date fingers so as to stress the noses disposed at the opposite ends of these fingers towards cogs of the date disk.

The present invention will be better understood with reference to the description of an exemplified embodiment and of the attached drawings, in which:

FIG. 1 represents a plan view illustrating the device according to the invention in its position of rest, FIG. 2 represents a plan view of the device shown by FIG. 1 in a first operational phase in which the display of the date has been corrected and the day is just being corrected, FIG. 3 shows a view similar to those in FIG. 1 and 2 in which the correction phase of the day display is in the extreme drive position, FIG. 4 represents the initial decrementing phase of the date disk which will be followed by a decrement of the day disk, FIGS. 5 to 9 represent operating diagrams for the device shown by FIGS. 1 to 4; and The device shown by FIG. 1 comprises a date disk 10, a drive wheel 11 coupled to a drive motor (not shown), a day disk 12 and a day star 13. The control mechanism for the date disk comprises two date fingers 14 and 15 formed by two clicks pivoting respectively around two axes 16 and 17, a spring 18 mounted on a pin 19 borne by the drive wheel 11 and a pawl 20 which acts on the cogs 21 of the date disk 10.

The control mechanism of the day disk comprises the day star 13, a control wheel 22 for this star mounted on the axis of the drive wheel 11 and integral therewith, and a pawl 23 acting on the day star.

An aperture in the form of an arc of a circle 24, in which a fixed stud 25 is engaged, is provided in the drive wheel 11. This fixed stud 25, which is integral with a fixed part of the watch, is designed to limit the travel of the drive wheel 11 when it is driven by the drive motor. In the position shown by FIG. 1, the stud 25 is centred with respect to the aperture and the control mechanism of the date disk is perfectly symmetrical.

The control wheel 22 of the day star 13 comprises an aperture 27 in the form of an arc of a circle in which the ends of date fingers 14 and 15 engage. Their angular displacements around axes 16, and 17 respectively, provoked by the return spring 18, are restricted by the edges of this aperture. In the position shown by FIG. 1, the date fingers 14 and 15 occupy the position of rest.

To modify the display of the date, an electronic circuit is designed to supply the motor with impulses which cause the rotation of the drive wheel 11 in the direction shown by arrow A in FIGS. 1 and 2. The date finger 14, stressed by the spring 18, is pushed into its position shown by FIG. 1 and its extremity, or nose **14*a*, is held in such a position that it catches one of the cogs 21 of the date disk at the moment when the drive wheel is driven in the direction of arrow A. The nose 14*a* and the cog 21 thrust by this nose, follow very close trajectories over a distance which corresponds to one step of the date disk. For this reason the nose 14*a* remains in contact with the cog, or more exactly catches in this cog over this distance. If the drive wheel continues to turn in order to reach the position shown by FIG. 2, the nose 14*a*** continues to move without being in contact with the cog of the date disk which has advanced by one step, i.e. that the number of the date appearing in the window of the dial of the watch is the number following that which previously appeared in this window when the mechanism occupied the initial position shown in FIG. 1.

It is noted that in this position the wheel 22 for controlling the day star, which comprises two tips 22*a* and 22*b* and two troughs 22*c* and 22*d*, respectively adjacent to said tips, comes into contact with the day star. More precisely the tip 22*b* comes into contact with one of the points 30 of this star, and as a result, if the drive wheel 11 continues to turn by driving the wheel 22, the day star 13 is rotated in the direction of arrow B, i.e. in a direction of rotation opposite to that shown by arrow A. The start of this displacement is shown by FIG. 2. The rotation of the day star 13 in the direction of arrow B has the effect of repelling the pawl 23 mounted at the end of an arm 26 into a position of unstable equilibrium where the point of the pawl abuts against the point of one of the stars 30. It will be noted that in this position the end of the aperture 24 shaped like the arc of a circle of the drive wheel 11 does not yet abut against the fixed stud 25 and that consequently the wheel may continue in the direction of arrow A, approximately into the position shown by FIG. 3, in which position the drive wheel 11 has reached the end of its journey, with the end of the aperture 24 abutting against said stud. In this position illustrated by FIG. 3, the day star has advanced by one step, the corresponding point having been repelled by an equivalent length, at the start of its journey by the tip 22*b* of the control wheel 22 and at the end of the journey by the pawl 23 acting on another point of this star. However, as the drive wheel 11 and consequently the control wheel 22 have not returned to their initial position, the day star 13 is blocked by the outer edge in the shape of an arc of the circle of the control wheel 22, and the pawl 23 can only bring this star into a stable position corresponding to the new days appearing in the corresponding window of the face of the watch when the point of the star blocked by said outer edge of the wheel 22 has passed the tip 22*b* and penetrates into the trough 22*d*. For this purpose, it will be noted that the control wheel 22 comprises a zone having a large radius limited by the two tips 22*a* and 22*b* and a zone having a reduced radius limited by the troughs 22*c* and 22*d*. It also comprises a boss 22*e* between the tips 22*a* and 22*b*, or between the troughs 22*c* and 22*d*, which has the effect of blocking the day star and preventing the rotation of this star when the control wheel 22 is in its position of rest, i.e. its centred position (FIG. 1).

FIG. 4 represents a view similar to the views of the preceding figures, but in which the drive wheel 11 is turned in the direction of arrow C, which is opposite to the direction shown by arrow A, so as to turn the date disk "backwards", i.e. in the direction opposite to that shown by FIG. 2. Such a manipulation may occur when setting the hour in the backward direction passing through midnight. In this case, the thrust exerted on the inner cogs 21 of the date disk 10 is made by the nose 15*a* of the date finger 15, and if the movement of the drive wheel 11 is continued, the displacement of the day star is performed, at least in its initial phase, by the tip 22*a* of the corresponding control wheel 22. Irrespective of the direction in which the date disk is displaced, the stable position is ensured by the pawl 20, which is designed to become engaged between two cogs 21 of this disk and to define thus the positions of this disk so that the dates appear completely and are centred in the corresponding window.

The originality of the system lies in the fact that by a single drive motor acting on a single drive wheel 11, it is possible, in a first phase, to displace in one direction or another, the date disk 10 and, in a second phase, to displace also in one direction or another the day star 13. This can be achieved more especially thanks to the perfect symmetry of the mechanism.

FIGS. 5 to 9 represent operating diagrams in which the time t is shown on the x axis, under the hypothesis that the motor constantly turns, and the angular displacement d of the drive wheel is shown on the y axis. The value $d_0$ is the angle which corresponds to the position of rest. It is situated half way between angles called abutment angles, which are positive $d_2$ and negative $d_4$ respectively, which correspond to rotations of the drive wheel bringing the edges of aperture 24 to rest against the fixed stud 25. The values $d_1$ and $d_3$ correspond to rotations of the drive wheel which are respectively necessary to drive the date disk by one step forwards and one step backwards. The rotations of the drive wheel of angles between $d_1$ and $d_2$ on the one hand and between $d_3$ and $d_4$ on the other hand have the effect of displacing the day disk by one step respectively forwards and backwards.

It will be noted that in the vicinity of the values $d_1$ and $d_3$ there are two zones z called neutral zones, which represent the angular path travelled by the drive wheel without producing any displacement either to the date disk or to the day disk. This zone is comparable with a safety zone which is able to ensure that if the drive wheel has performed an angular displacement of between $d_0$ and $d_1$ the date disk has advanced by one step without the displacement of the day disk having commenced.

To ensure the rotation of the drive wheel, there is used one bi-directional stepping motor having one set of gears (not shown) which is mounted between the drive motor and the drive wheel. To produce the angular displacement $(d_1-d_0)$ the electronic circuit provides the drive motor with a number of motor steps N. To produce the angular displacement $(d_3-d_0)$ the electronic circuit transmits a number of $-N$ motor steps to the drive motor. The angle $(d_2-d_0)$ corresponds to a number $+(N+M)$ of motor steps, M being the number of motor steps necessary to produce the angular displacement $(d_2-d_1)$ and the angle $(d_4-d_0)$ corresponds to number $-(N+M)$ of motor steps. The number of steps n between 1% and 20% of the quantity $(N+M)$ enables the displacement of the drive wheel to be ensured until the edges of the aperture 24 abut against the fixed stud 25, the number of these steps being $+n$ for the stop corresponding to the angular displacement $d_4$. The existence of the number n of steps enables the correction of the missed steps to be ensured or the compensation of a decentring of the mechanism caused by shocks, for example.

In FIG. 5, curve I comprising two segments PQ and QR corresponds to a forward movement of one increment of the date disk and the return of the mechanism into the centred position. The motor impulses necessary to produce these displacements correspond respectively to $+N$ for segment PQ and to $-N$ for segment QR.

Curve II, which comprises two segments P'Q' and Q'R', corresponds to the backward movement by one increment of the date disk and to the return of the drive wheel into the centred position. The number of motor impulses is respectively $-N$ and $+N$ impulses.

Curve III, which comprises segments AB, BC and CD, corresponds to the forward movement by one increment of the date disk and one increment of the day disk and also the return of the drive wheel into the centred position. The motor impulses applied to produce the angular displacement corresponding to segment AB is +(M+N). The number of motor impulses applied to travel through segment BC is +n impulses and the angular displacement CD corresponds to −(M+N) impulses.

Curve IV, which comprises segments A'B', B'C' and C'D', corresponds to the backward movement by one increment of a date disk and one increment of the day disk and to the return of the drive wheel into the centred position. The impulses applied to the motor are respectively −(M+N), −n and +(M+N).

FIG. 6 represents a diagram similar to that shown by FIG. 5, but in which curve V, which comprises segments ST, TU, UV, VW and WX, corresponds to the backward movement by one increment of the date disk and to the forward movement by one increment of the date disk and of the day disk, which corresponds in practice to the forward movement of just the day disk. The corresponding motor impulses are respectively −N, +N, +(M+N), +n and −(M+N).

On the same figure is plotted curve VI, which comprises segments S'T', T'U', U'V', V'W' and W'X'. The corresponding motor impulses are respectively +N, −N, −(M+N), −n and +(M +N). This curve corresponds to the forward movement by one increment of the date disk and the backward movement by one increment of the date disk and the day disk, the result of these movements being the backward movement of just the day disk.

FIG. 7 is a diagram which illustrates the correction of missed steps based on a negative or positive error in the position of rest of the drive wheel. Curve VII, which comprises the rectilinear segment $A_1B_1$, the curved segment $B_1C_1$ and the rectilinear segment $C_1D_1$, corresponds to the correction of steps based on a negative error in the position of rest and to the forward movement by one increment of the date disk and of the day disk. The corresponding motor impulses are +(M+N), +n and −(M+N).

Curve VIII, which comprises the curved segment $A_2B_2$, the rectilinear segment $B_2C_2$ and the rectilinear segment $C_2D_2$, corresponds to the correction of missed steps based on a positive error in the position of rest and the forward movement by one increment of the date and day disks. The corresponding motor impulses are −(M+N), +n and +(M+N).

Curve IX comprises the rectilinear segment $A'_1B'_1$, curved segment $B'_1C'_1$ and rectilinear segment $C'_1D'_1$. The corresponding motor impulses are respectively −(M+N), −n and +(M+N).

This plot corresponds to the correction of missed steps based on a positive error in the position of rest and to the backward movement by one increment of the date and day disks.

FIG. 8 shows a case where the initial position shown by point $A_3$ is positive and lies between the angular values $d_0$ and $d_2$.

Figure 1:
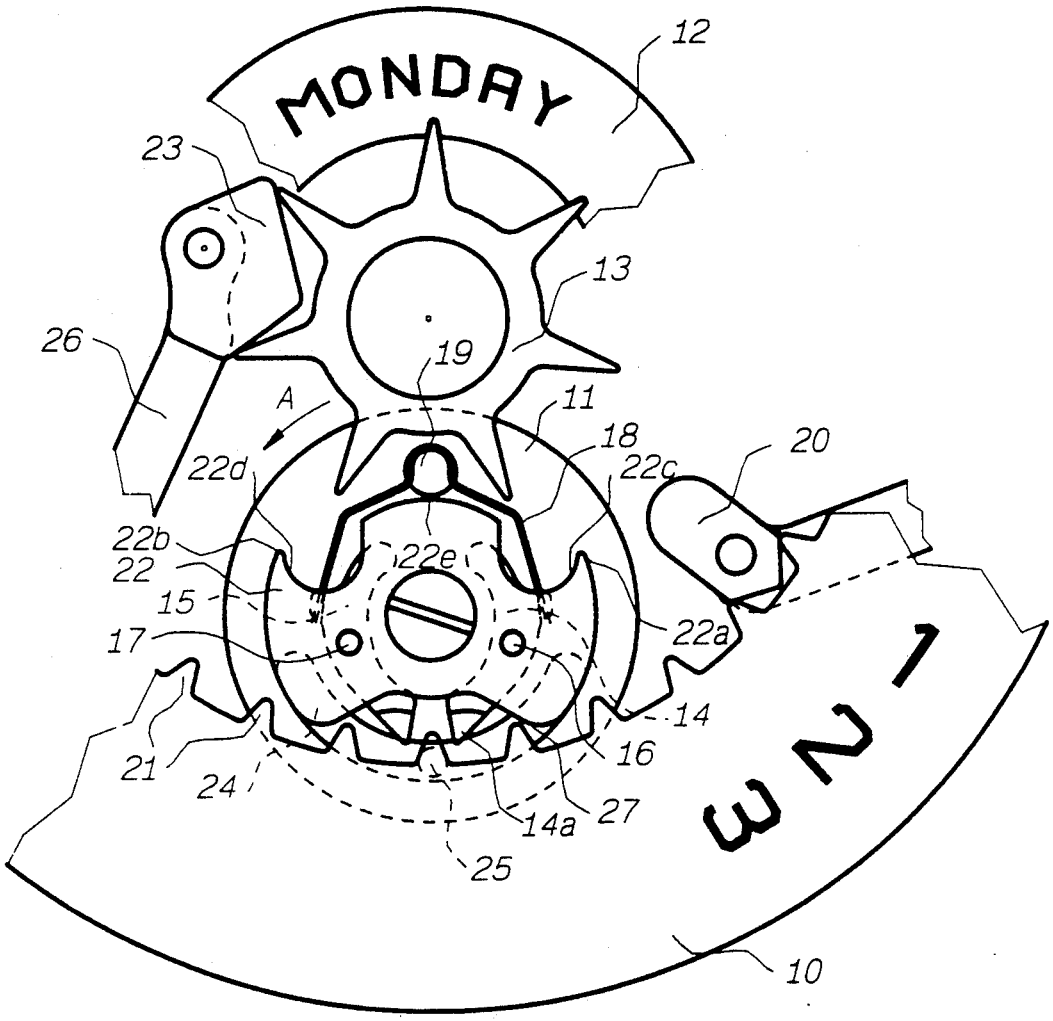
Figure 2:
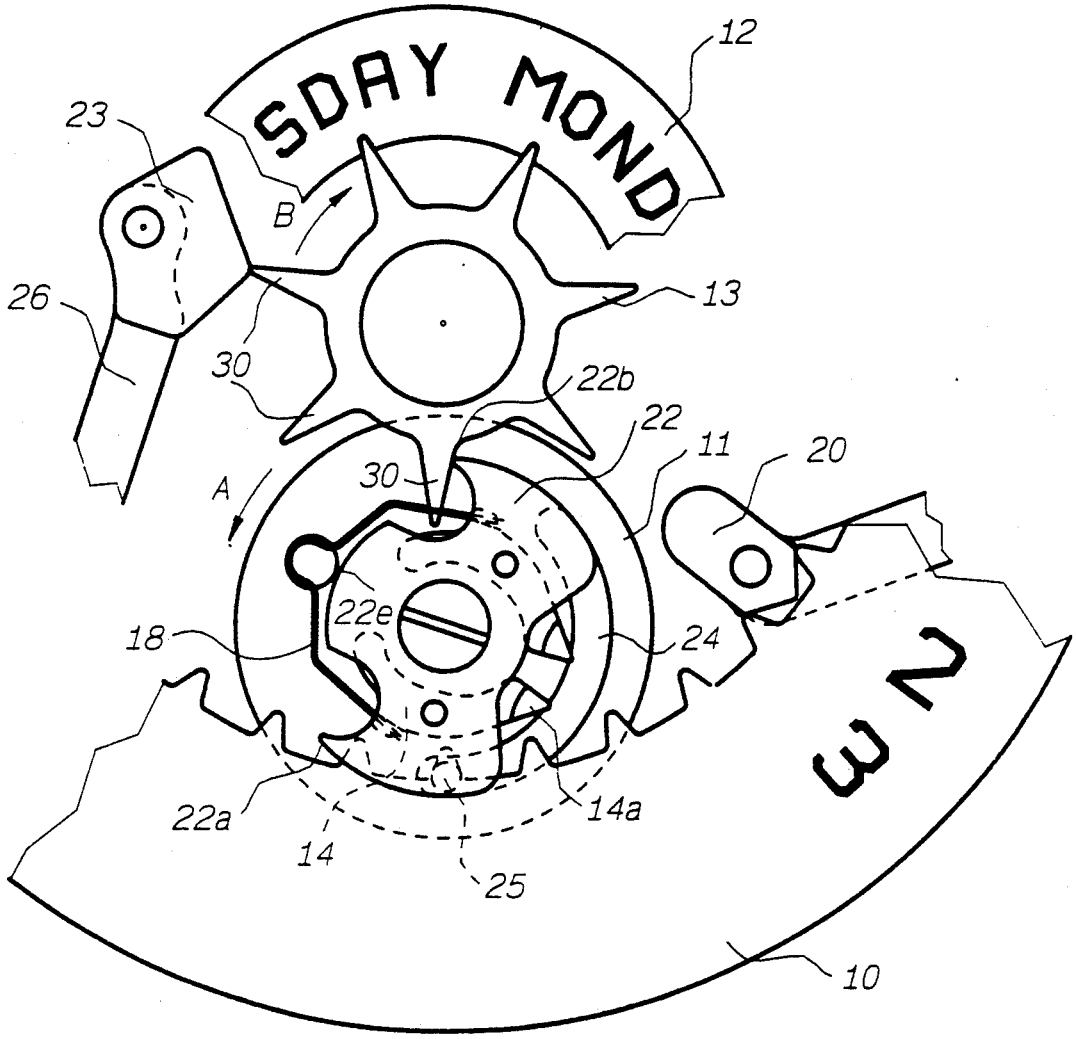
Figure 3:
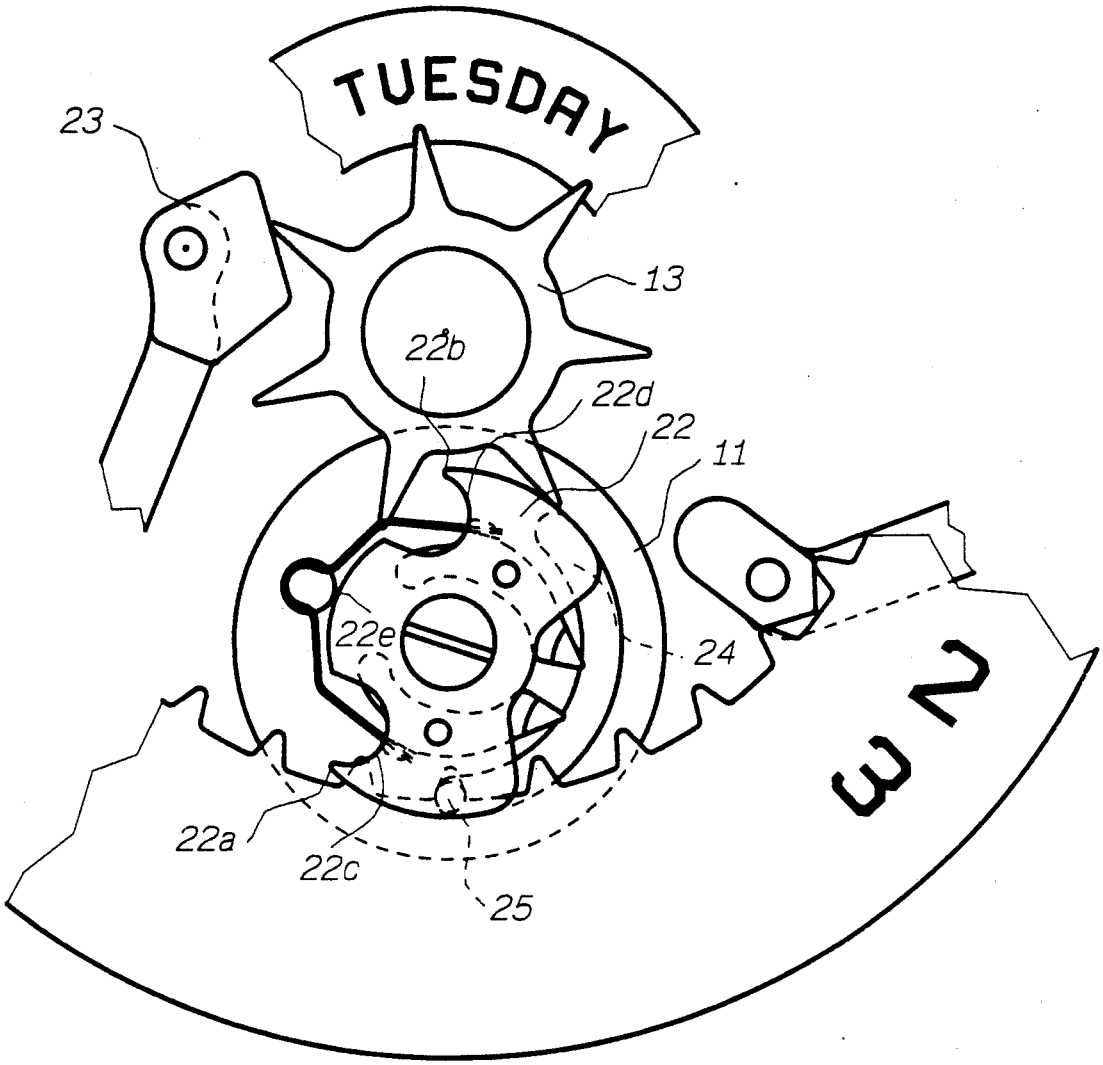
Figure 4:
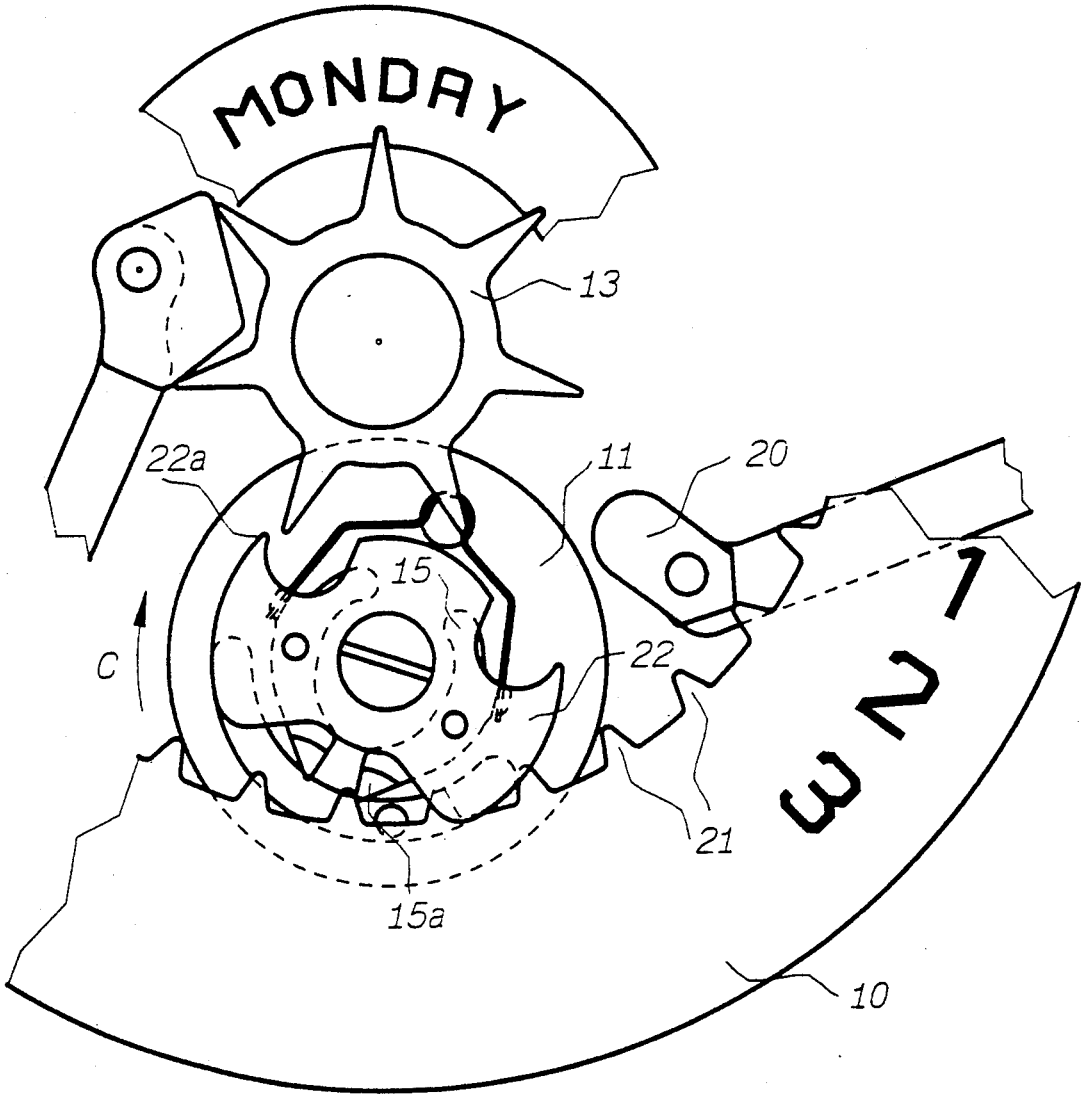
Figure 5:
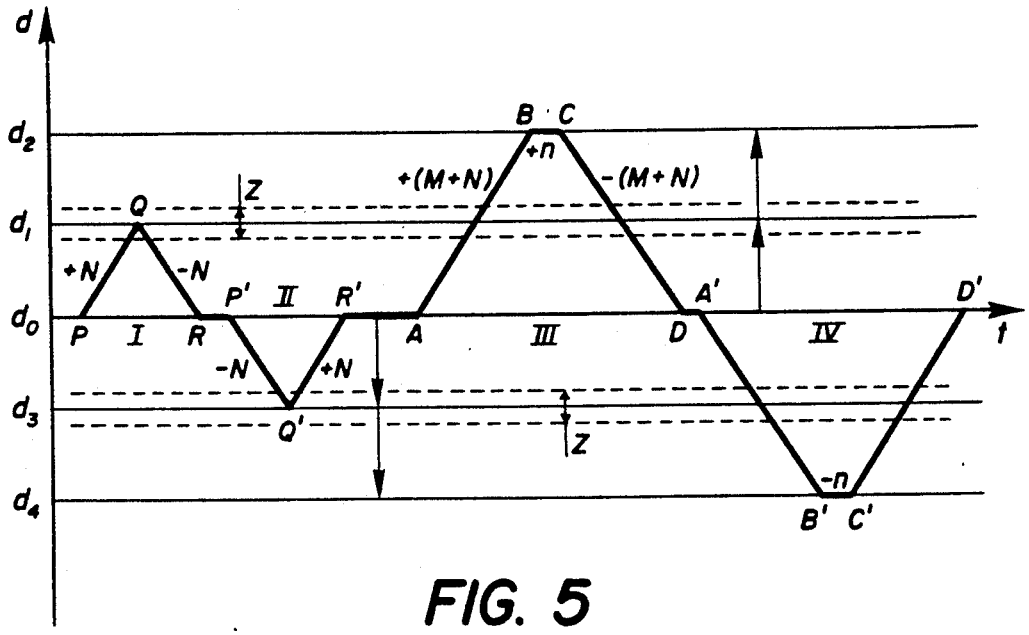
Figure 6:
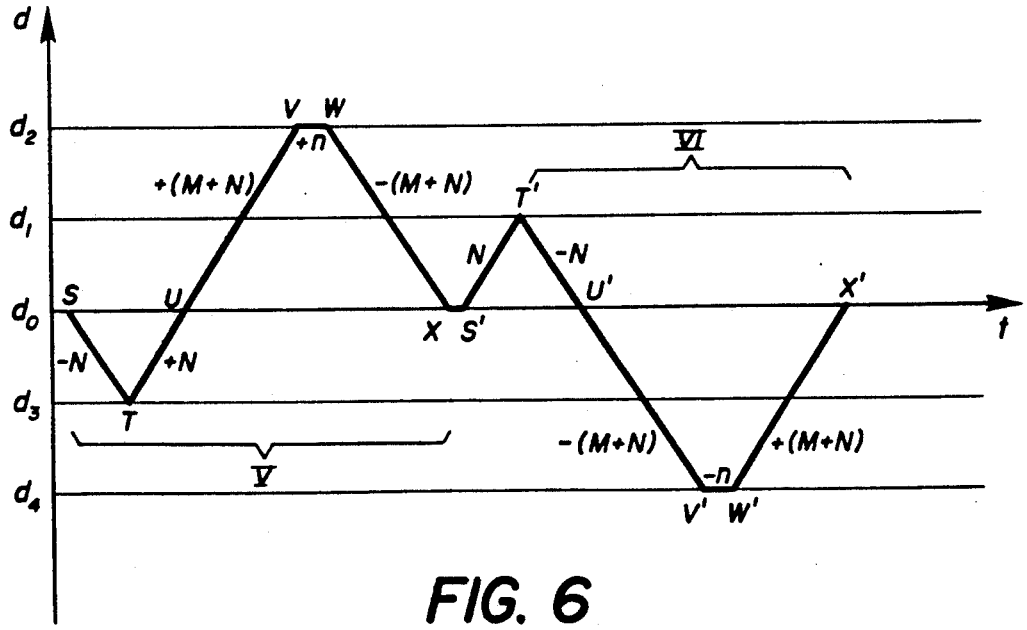
Figure 7:
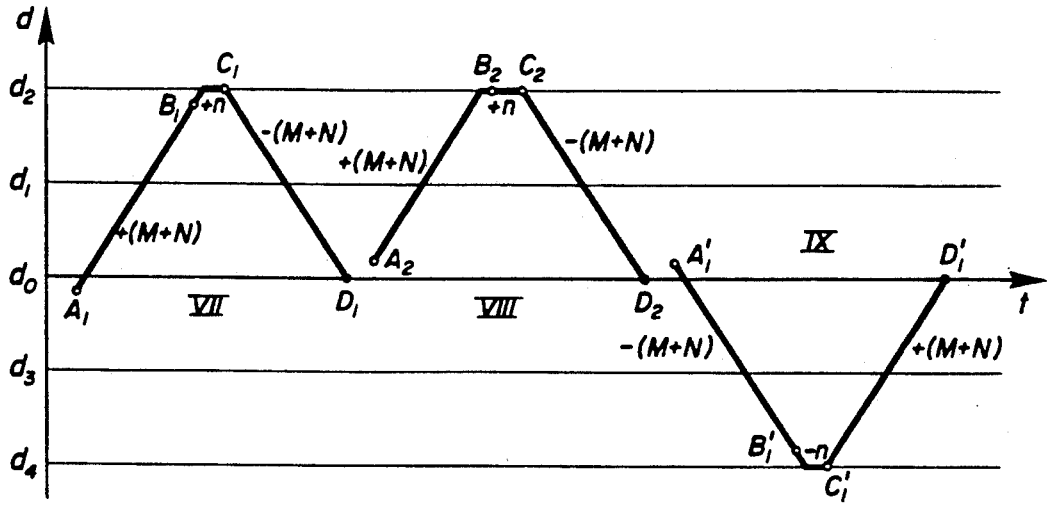
Figure 8:
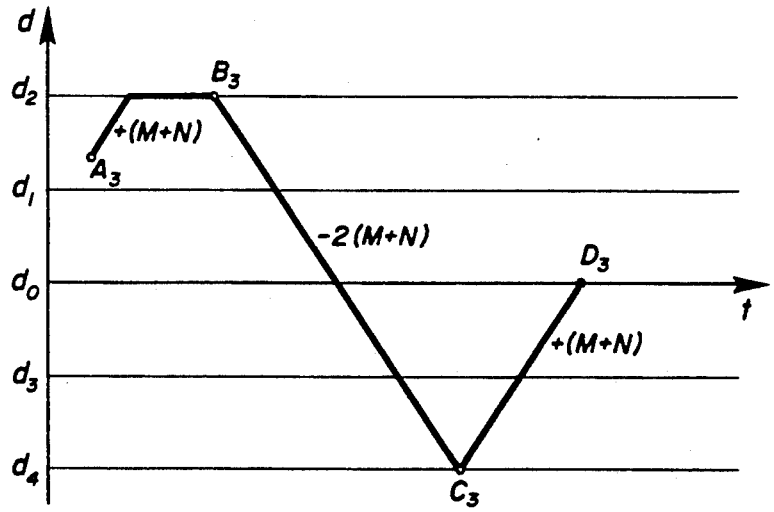
FIGS. 8 and 9 are diagrams illustrating automatic initialisation, when a battery is changed, for example, which is a process which permits, regardless of the initial position of the drive wheel, the recentering of the mechanism and especially of the drive wheel in the position of rest or centred position.
Figure 9:
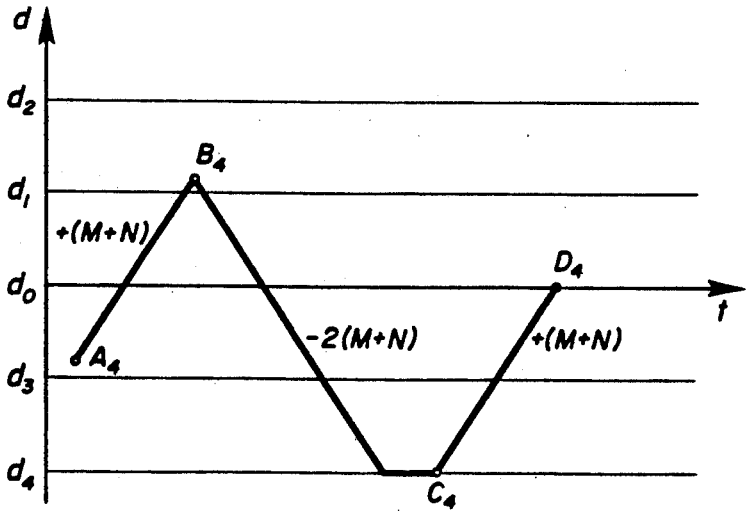
Figure 10:
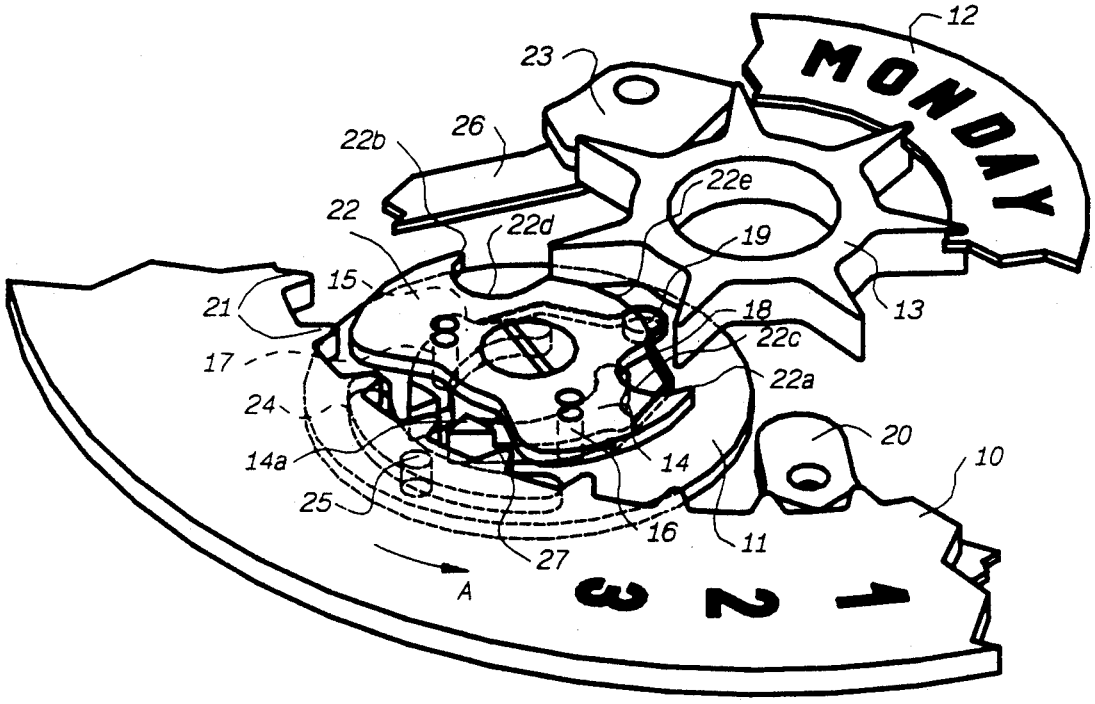

FIG. 9 represents a case in which the initial position shown by point $A_4$ is negative and corresponds to an angular deviation of between $d_4$ and $d_0$. In the two cases, the sequence of motor steps is as follows : (M+N) steps in the positive direction followed by 2(M+N) steps in the negative direction followed by (M+N) steps in the positive direction. Other sequences could be conceived, with the conditions to be met consisting of ensuring that one or other of the stops is reached so as then to reposition the drive wheel in the position of rest $d_0$ or centred position. This may be achieved in particular by the sequence mentioned above.

The present invention is not strictly restricted to the embodiment described but could undergo various modifications and be presented under various refinements evident to a person skilled in the art.

I claim:

1. A device for controlling and correcting the display of the day and date for a watch, comprising at least one bi-directional electric motor, at least one mechanism coupled to this motor to drive a day disk and a date disk, and at least one electronic circuit designed to transmit impulses to control this motor, in which the mechanism comprises a drive wheel (11) coupled to the motor and two date fingers (14, 15) pivoting respectively on two axes (16, 17) borne by said drive wheel (11) to increment, or decrement respectively, the date disk, characterised in that the drive wheel (11) also bears a control wheel (22) for a day star (13) designed to increment, or decrement respectively, the day disk (12) by means of said day star (13).

2. A device according to claim 1,
characterised in that the control wheel (22) for the day star is concentric with the drive wheel (11) and integral with the latter during its rotational movements in one direction or the other.

3. A device according to claim 2,
characterised in that the angular displacement of the control wheel (22) for the day star is restricted to the angular displacement of the drive wheel (11).

4. A device according to claim 2,
characterised in that the control wheel (22) of the day star (13) comprises two tips (**22*a*, 22*b***) symmetrical with respect to a median plane and designed to rest on a point of the day star and to make it move forwards, or move backwards respectively, by a step corresponding to one increment of the day disk.

5. A device according to claim 4,
characterised in that the control wheel (22) for the day star comprises a boss (**22*e*) located between the tips (22*a*, 22*b*), the radius of which is such that it ensures a locking of the day star when the control wheel (22**) is in its position of rest.

6. A device according to claim 1,
characterised in that it comprises a return spring (18) mounted on a pin (19) and which is in contact with an extremity of the date fingers (14, 15) so as to stress the noses disposed at the opposite extremities of these fingers towards cogs on the date disk (10).

7. A device according to claim 1, characterized in that said device is incorporated into a wrist watch.

* * * * *